US005402947A

United States Patent [19]

Petersen

[11] Patent Number: 5,402,947

[45] Date of Patent: Apr. 4, 1995

[54] MEDIA GRANULATION APPARATUS

[76] Inventor: Donald E. Petersen, 414 Oswego St., Aurora, Colo. 80010

[21] Appl. No.: 93,461

[22] Filed: Jul. 19, 1993

[51] Int. Cl.[6] ..... B02C 23/24; B02C 23/38; B02C 19/06

[52] U.S. Cl. ..... 241/39; 241/41; 241/52; 241/57; 241/79; 241/80

[58] Field of Search ..... 241/5, 39, 41, 42, 52, 241/57, 61, 79, 80, 97

[56] References Cited

U.S. PATENT DOCUMENTS

| | | | |
|---|---|---|---|
| 2,032,827 | 3/1936 | Andrews | 241/39 X |
| 2,391,723 | 12/1945 | Mann | 241/39 X |
| 2,628,786 | 2/1953 | Piperoux et al. | 241/39 |
| 2,690,880 | 10/1954 | Chatelain | 241/39 |
| 2,856,268 | 10/1958 | Young | 241/39 X |
| 2,958,472 | 11/1960 | Erickson et al. | 241/39 |
| 3,178,121 | 4/1965 | Wallace, Jr. | 241/39 X |
| 3,602,439 | 8/1971 | Nakayama | 241/39 |
| 3,937,405 | 2/1976 | Stephanoff | 241/39 |

OTHER PUBLICATIONS

Soviet Union abstract (0662143), May 1979.

*Primary Examiner*—Timothy V. Eley

[57] ABSTRACT

A new and improved media granulation apparatus includes a cyclone chamber assembly which includes an outer wall, a plurality of vortex controller assemblies connected to the outer wall, and an inner wall. A first conduit is connected to the inlet of the cyclone chamber assembly. A blower assembly is connected to the first conduit, for creating a cyclone flow within the cyclone chamber assembly, and a media feed assembly is connected to the first conduit for supplying media to be ground to the cyclone chamber assembly. The respective vortex controller assemblies include a vortex control element which is substantially cylindrical, e.g. D-shaped, in cross-section and a pivot for connecting one end of the vortex control element to the outer wall. A slot-riding connector is connected to the vortex control element for riding in an arced slot in the outer wall. The vortex control element can be selectively tilted around the pivot allowing the slot-riding connector to ride in the arced slot for controlling an angular orientation of the vortex control element within the cyclone chamber assembly, such that, by controlling the angular orientation of the vortex control element within the cyclone chamber assembly, granulation time of media in the cyclone chamber assembly is controlled. An auger feeder assembly is connected to a feed conduit for moving media from a hopper into the cyclone chamber assembly.

10 Claims, 4 Drawing Sheets

5
23

20
15
27
30
5
25
22
28
15
29
24

26
17
24

15
6
6
30
28

MEDIA GRANULATION APPARATUS

BACKGROUND OF THE INVENTION

1. Field of the Invention

The present invention relates generally to apparatus and methods for reducing the size of material, and, more particularly, to apparatus and methods for providing granulated materials.

2. Description of the Prior Art

Machines that reduce large pieces or clumps of material into smaller pieces are well known in the art. Generally, such machines employ a grinder element that is rotated by a motor. There are certain disadvantages, however, associated with the use of such machines. One problem is the tendency of the ground up material to escape the grinding chamber and become trapped between the shaft which rotates the grinder and the grinding chamber. Although many types of special seals have been developed over the years to seal drive shafts from a driven grinding element, such seals often fail or need periodic maintenance to retain their integrity. In this respect, it would be desirable if a device for granulating material were provided which does not permit ground material to become trapped between a shaft which rotates a grinding element and a grinding chamber. Also, it would be desirable if a device were provided for granulating material that does not need a seal between a grinding element and a drive shaft.

Another problem associated with devices that have rotating grinding elements is vibration that can occur when the grinding element rotates in the process of granulating material. In this respect, it would be desirable if a grinding device were provided which did not undergo vibrations caused by a rotating grinding element.

When material is comminuted into smaller pieces, heat is often generated during the comminution process. Excessive heat build up can often damage both the material being ground and the apparatus in which the grinding is carried out. In this respect, it would be desirable if a grinding device were provided which carried heat away from the material being ground.

When a material is being ground, the dust particles are often formed. In this respect, it would be desirable if a grinding device were provided which collected the dust produced during the grinding process.

During a grinding process, particles of selected size are often desired. Particles which are within the desired size range are collected. Particles that are larger than the desired size can be recycled to be ground again. In this respect, it would be desirable if a grinding device were provided which included means for collecting particles in the desired size range and included means for recycling particles larger than desired.

During a grinding operation, control of ground particles is often related to the time period that the material undergoes the grinding operation. In this respect, it would be desirable if a grinding device were provided which permitted control of the time period in which the material undergoes the grinding operation.

In a complex process for grinding, collecting, and recycling a material, the material must be moved from one station to another. Conveyor belts may be used, but particulate material ;may be blown off the conveyor. In this respect, it would be desirable if a grinding device were provided that included means for conveying material from one station to another without losing material.

Conveyor belts are complex devices that include many moving parts. In conveying materials from one station to another it would be desirable if conveying means were provided which were simple and did not include moving parts.

Grinding processes which include a rotating element in a grinding chamber are often batch processes. For a number of reasons, continuous processes are often preferred over batch processes. In this respect, it would be desirable if a grinding device were provided that permitted the grinding process to be carried out continuously.

Thus, while the foregoing body of prior art indicates it to be well known to use devices to grind and granulate material, the prior art described above does not teach or suggest a media granulation apparatus which has the following combination of desirable features: (1) does not permit ground material to become trapped between a drive shaft, which rotates a grinding element, and a grinding chamber; (2) does not need a seal between a grinding element and a drive shaft; (3) does not undergo vibrations caused by a rotating grinding element; (4) carries heat away from the material being ground; (5) collects the dust produced during the grinding process; (6) includes means for collecting particles in the desired size range and includes means for recycling particles larger than desired; (7) permits control of the time period in which the material undergoes the grinding operation; (8) includes means for conveying material from one station to another without losing material; (9) permits the grinding process to be carried out continuously; and (10) provides conveying means which are simple and do not include moving parts. The foregoing desired characteristics are provided by the unique media granulation apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved media granulation apparatus which includes a cyclone chamber assembly which includes an outer wall, a plurality of vortex controller assemblies connected to the outer wall, and an inner wall. The cyclone chamber assembly also includes an inlet, a dust outlet, and a granulated media outlet. A first conduit is connected to the inlet of the cyclone chamber assembly. A blower assembly is connected to the first conduit, for creating a cyclone flow within the cyclone chamber assembly, and a media feed assembly is connected to the first conduit for supplying media to be ground to the cyclone chamber assembly.

There are a plurality of outer wall flat portions in the outer wall, and a vortex control element is located on every other outer wall flat portion. In addition, there are an equal number of a plurality of inner wall flat portions in the inner wall. Moreover, the outer wall flat portions are arranged in a special arrangement with respect to the inner wall flat portions. More specifically, a plane of the perpendicular bisectors of each outer wall flat portion intersects a line of apexes between adjacent inner wall flat portions.

The cyclone chamber assembly includes a funnel-shaped collector portion connected to the outer wall and positioned below the outer wall and the inner wall 19 and above the granulated media outlet 22. A portion of the dust vent tube extends below the outer wall 15 and the inner wall 19 into the funnel-shaped collector portion 25.

The respective vortex controller assemblies include a vortex control element which is substantially cylindrical, e.g. D-shaped, in cross-section and a pivot for connecting one end of the vortex control element to the outer wall. A slot-riding connector is connected to the vortex control element for riding in an arced slot in the outer wall. The vortex control element can be selectively tilted around the pivot allowing the slot-riding connector to ride in the arced slot for controlling an angular orientation of the vortex control element within the cyclone chamber assembly, such that, by controlling the angular orientation of the vortex control element within the cyclone chamber assembly, granulation time of media in the cyclone chamber assembly is controlled. The media feed assembly includes a hopper, legs for supporting the hopper, and a feed conduit connected to the hopper. An auger feeder assembly is connected to the feed conduit for moving media from the hopper through the feed conduit to the first conduit which feeds into the cyclone chamber assembly.

An air classifier assembly may be connected to the cyclone chamber assembly at the granulated media outlet. The air classifier assembly is capable of separating granulated media into media of a selected particle size range. The air classifier assembly is also capable of recycling media that is larger than the selected particle size range back to a media hopper.

A dust collection assembly may be connected to the dust outlet of the cyclone chamber assembly. The dust collection assembly includes an interconnection conduit that is connected to the dust outlet of the cyclone chamber assembly. A baghouse assembly is connected to the interconnection conduit for collecting and bagging dust from the cyclone chamber assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved media granulation apparatus which has all of the advantages of the prior art and none of the disadvantages.

It is another object of the present invention to provide a new and improved media granulation apparatus which may be easily and efficiently manufactured and marketed.

It is a further object of the present invention to provide a new and improved media granulation apparatus which is of durable and reliable construction.

An even further object of the present invention is to provide a new and improved media granulation apparatus which is susceptible of a low cost of manufacture with regard to both materials and labor, and which accordingly is then susceptible of low prices of sale to the consuming public, thereby making such media granulation apparatus available to the buying public.

Still yet a further object of the present invention is to provide a new and improved media granulation apparatus which does not permit ground material to become trapped between a drive shaft, which rotates a grinding element, and a grinding chamber.

Still another object of the present invention is to provide a new and improved media granulation apparatus that does not need a seal between a grinding element and a drive shaft.

Yet another object of the present invention is to provide a new and improved media granulation apparatus which does not undergo vibrations caused by a rotating grinding element.

Even another object of the present invention is to provide a new and improved media granulation apparatus that carries heat away from the material being ground.

Still a further object of the present invention is to provide a new and improved media granulation apparatus which collects the dust produced during the grinding process.

Yet another object of the present invention is to provide a new and improved media granulation apparatus that includes means for collecting particles in the desired size range and includes means for recycling particles larger than desired.

Still another object of the present invention is to provide a new and improved media granulation apparatus which permits control of the time period in which the material undergoes the grinding operation.

Yet another object of the present invention is to provide a new and improved media granulation apparatus that includes means for conveying material from one station to another without losing material.

Still a further object of the present invention is to provide a new and improved media granulation apparatus that permits the grinding process to be carried out continuously.

Yet another object of the present invention is to provide a new and improved media granulation apparatus which provides conveying means which are simple and do not include moving parts.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved media granulation apparatus embodying the principles and concepts of the present invention will be described.

Figure 2:
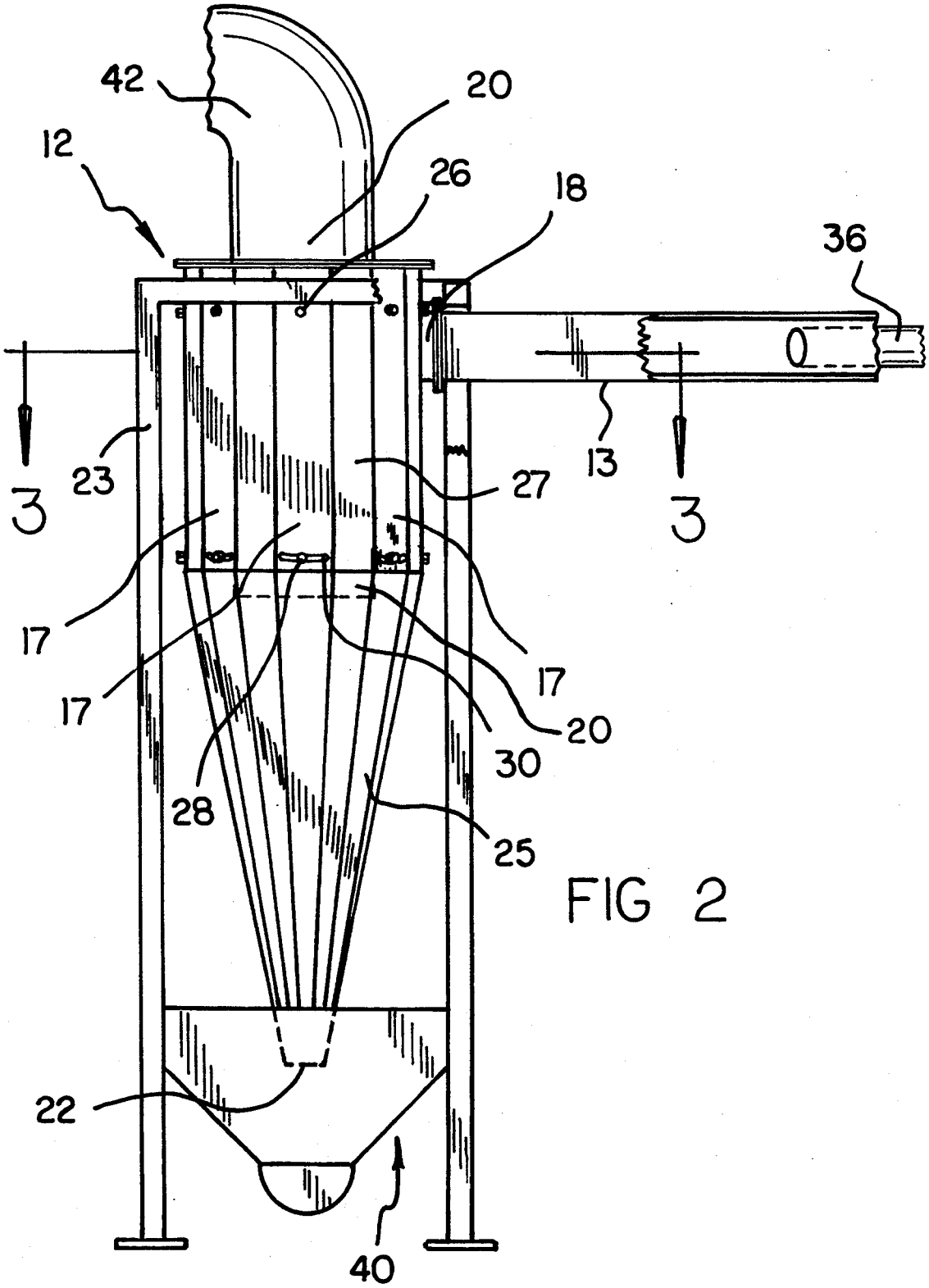
FIG. 2 is an enlarged side view, partially broken away, of the embodiment of the media granulation apparatus of the invention shown in FIG. 1 in combination with a particle classifier unit.
Figure 3:
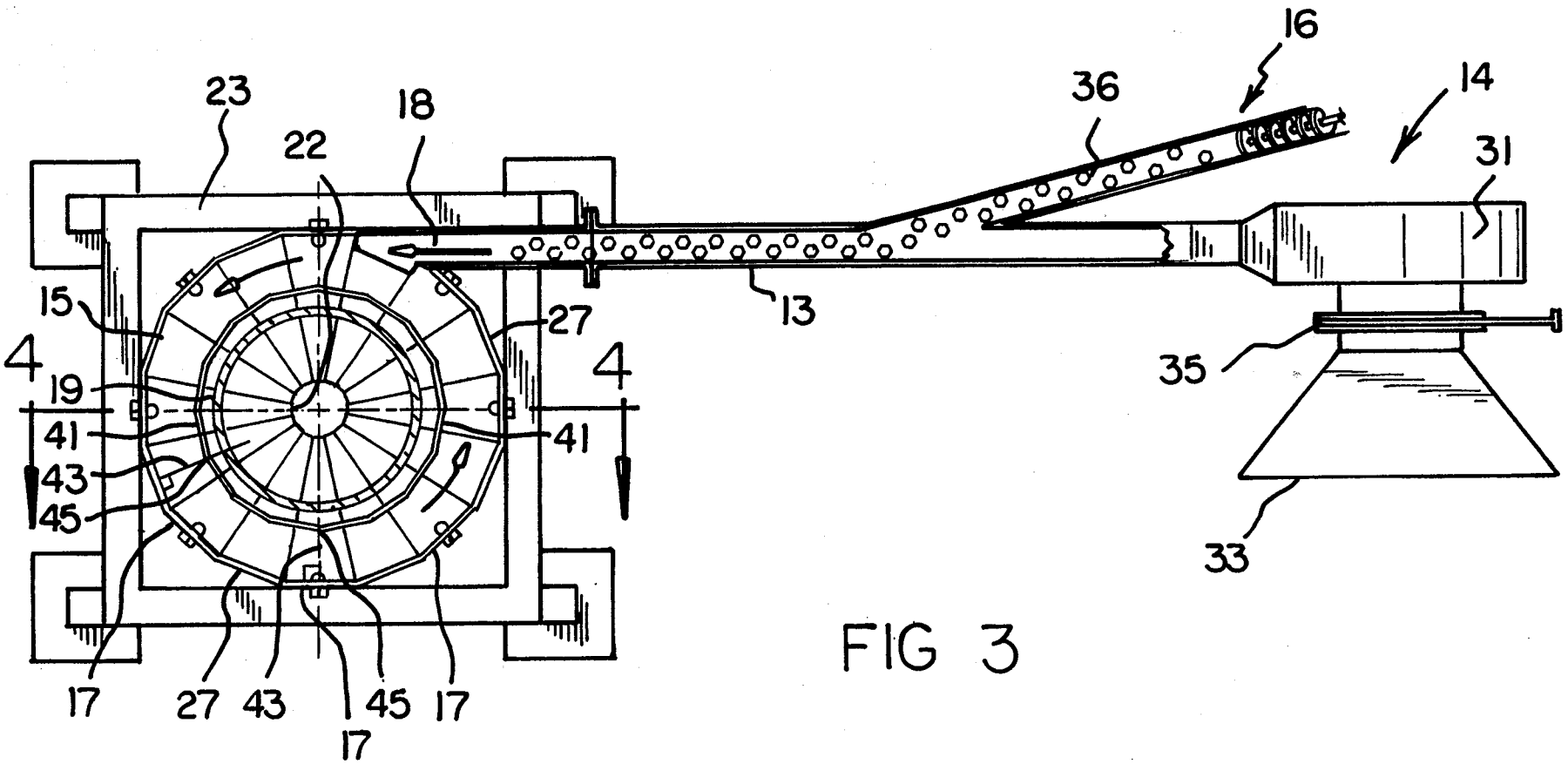
FIG. 3 is a cross-sectional view of the media granulation apparatus of FIG. 2 taken along line 3—3 thereof.

As shown in greatest detail in FIGS. 2 and 3, a new and improved media granulation apparatus includes a cyclone chamber assembly 12 which includes an outer wall 15, a plurality of vortex controller assemblies 17 connected to the outer wall 15, and an inner wall 19. The cyclone chamber assembly 12 also includes an inlet 18, a dust vent tube 20, and a granulated media outlet 22. A framework 23 is used to support the cyclone chamber assembly 12. A funnel-shaped portion 25 extends from the outer wall 15 to the granulated media outlet 22. A first conduit 13 is connected to the inlet 18 of the cyclone chamber assembly 12. A blower assembly 14 is connected to the first conduit 13, for creating a cyclone flow within the cyclone chamber assembly 12, and a media feed assembly 16 is connected to the first conduit 13 for supplying media to be ground to the cyclone chamber assembly 12.

Figures 4, 5, 6:
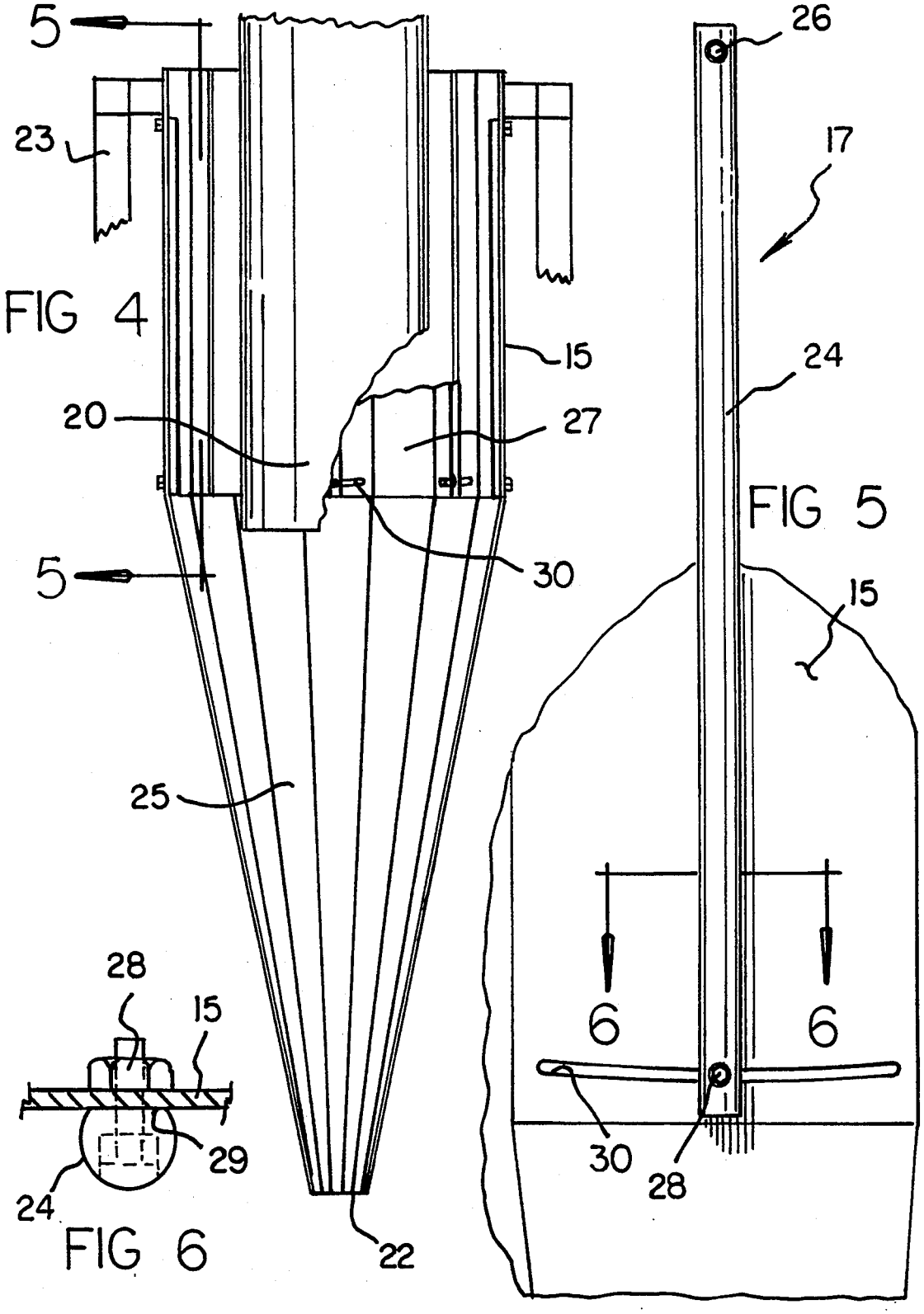
FIG. 4 is an enlarged side view, partially broken away, of the embodiment of the media granulation apparatus of the invention shown in FIG. 2 without being combined with the particle classifier unit.
FIG. 5 is an enlarged cross-sectional view of the embodiment of the invention shown in FIG. 4 showing a side view of a vortex controller assembly.
FIG. 6 is a cross-sectional view of the vortex controller assembly shown in FIG. 5.

As shown in greatest detail in FIGS. 5 and 6, the respective vortex controller assemblies 17 include a vortex control element 24 which is substantially cylindrical, e.g. D-shaped, in cross-section and a pivot 26 for connecting one end of the vortex control element 24 to the outer wall 15. A slot-riding connector 28 is connected to the vortex control element 24 for riding in an arced slot 30 in the outer wall 15. The vortex control element 24 can be selectively tilted around the pivot 26 allowing the slot-riding connector 28 to ride in the arced slot 30 for controlling an angular orientation of the vortex control element 24 within the cyclone chamber assembly 12, such that, by controlling the angular orientation of the vortex control element 24 within the cyclone chamber assembly 12, granulation time of media in the cyclone chamber assembly 12 is controlled. It is clear that once the vortex controller assemblies 17 are set to their selected angular orientations, the cyclone chamber assembly 12 has no moving parts as the media are granulated therein.

Another benefit from using the media granulation apparatus of the invention is that the media are maintained in a dry condition throughout the processing. This is in sharp contrast to slurry-based systems which require special drying operations after the grinding operations take place. With the invention, in essence, both a grinding and a drying operation take place simultaneously.

Figure 1:
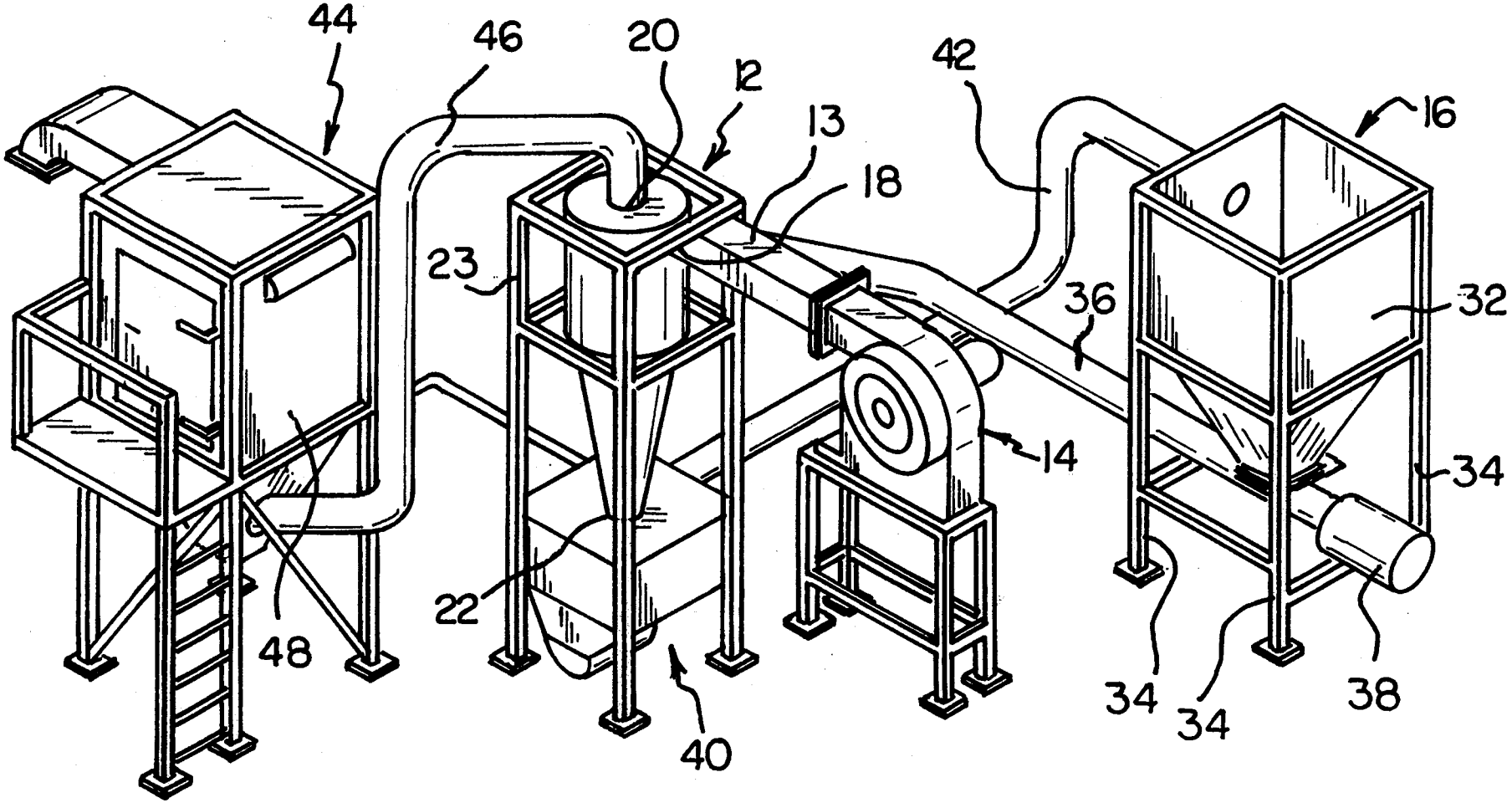
FIG. 1 is a perspective view showing a preferred embodiment of the media granulation apparatus of the invention in combination with a material feed unit, a recycle unit, a classifier unit, and a bagger unit.

As shown in FIG. 1, the media feed assembly 16 includes a hopper 32, legs 34 for supporting the hopper 32, and a feed conduit 36 connected to the hopper 32. An auger feeder assembly 38 is connected to the feed conduit 36 for moving media from the hopper 32 through the feed conduit 36 to the first conduit 13 which feeds into the cyclone chamber assembly 12.

As shown in FIGS. 1 and 2, an air classifier assembly 40 may be connected to the cyclone chamber assembly 12 at the granulated media outlet 22. The air classifier assembly 40 is capable of separating granulated media into media of a selected particle size range. The air classifier assembly 40 is also capable of recycling media that is larger than the selected particle size range back to a media hopper 32. An interconnection conduit 42 is used to connect the air classifier assembly 40 to the hopper 32 of the media feed assembly 16.

As shown in FIG. 1, a dust collection assembly 44 may be connected to the dust vent tube 20 of the cyclone chamber assembly 12. The dust collection assembly 44 includes an interconnection conduit 46 that is connected to the dust vent tube 20 of the cyclone chamber assembly 12. A baghouse assembly 48 is connected to the interconnection conduit 46 for collecting and bagging dust from the cyclone chamber assembly 12.

More specifically, there are eight vortex control elements 24 in the cyclone chamber assembly 12 shown in the drawings. There are sixteen outer wall flat portions 27 in the outer wall 15, and a vortex control element 24 is located on every other outer wall flat portion 27. In addition, there are sixteen inner wall flat portions 41 in the inner wall 19. Moreover, the sixteen outer wall flat portions 27 are arranged in a special arrangement with respect to the sixteen inner wall flat portions 41. More specifically, a plane of the perpendicular bisectors 43 of each outer wall flat portion 27 intersects a line of apexes 45 between adjacent inner wall flat portions 41.

Each respective vortex control element 24 is an approximately ½ inch stainless steel rod which is machined to an approximately "D" shape (which is significantly cylindrical) which has a flat portion 29 which is approximately ⅜ inch across the flat width. The pivot 26 is a shoulder bolt that has its head recessed into a counterbore in the vortex control element 24 through a drilled hole in the outer wall 15 and secured from the outside of the outer wall 15 with a washer and a nut.

The slot-riding connector 28 can be moved in the arced slot 30 through a range of approximately 30 degrees which enables the user to fine tune the amount of time the media is ground and stays in air suspension in the cyclone chamber assembly 12.

To charge media from the hopper 32 into the cyclone chamber assembly 12, the auger feeder assembly 38 moves media through feed conduit 36. The feed conduit 36 terminates at first conduit 13 where an air stream from the blower assembly 14 is present. The air stream from the blower assembly 14 picks up and carries the media from the feed conduit 36 into the cyclone chamber assembly 12. The rapid passage of blown air past the convergence of the feed conduit 36 and the first conduit 13 creates a vacuum on the feed conduit 36, such that a smaller than otherwise auger feeder assembly 38 can be used for feeding media into the feed conduit 36.

More specifically with respect to the blower assembly 14, a readily available commercial blower is suitable that produces 5,000 C.F.M./7 inches static running at 2,400 R.P.M. which is presently powered by a General Electric 15 H.P. motor.

Preferably, the media that is fed into the cyclone chamber assembly 12 is pre-crushed to a cubic size of 1 inch diameter or less. Starting with particles of this size, by use of the cyclone chamber assembly 12 of the invention, particles have been produced that are 200 sieve mesh size.

As is readily apparent, the cyclone chamber assembly 12 has no parts that move during the grinding process. Once the media have entered into the cyclone chamber assembly 12, they travel in a counter clockwise motion causing a cyclonic action which keeps the media in air suspension during granulation. The vortex control elements 17 are adjustable to control the amount of time the media remain in the air suspension. The unique sixteen sided configuration of the outer wall 15 keeps the media moving into the center of the air flow. The media particles bump up and crash against one another causing large particles to break into smaller particles. The granulation process of air suspension is continued until media of the desired particle size is obtained. Dust from the granulation process exits from dust vent tube 20 and travels to the baghouse assembly 48. Finished, granulated media exit from the granulated material outlet 22. The granulated media are passed through an air classifier assembly 40 from which acceptable granulated media are collected and bagged. Media that is still unacceptably large is conveyed by interconnection conduit 42 to the material feed assembly 16 from where it will enter the cyclone chamber assembly 12 again.

The granulated media produced by the invention are smooth surfaced and round in shape. No sharp edges, that may have been present after an initial preparatory crushing or cracking operation, are present after passing through the cyclone chamber assembly 12 of the invention.

As shown in FIG. 3, the blower assembly 14 includes a blower 31 which includes an air inlet 33. A sliding valve 35 is operated to control the amount of air that the blower 31 blows by the feed conduit 36 and into the cyclone chamber assembly 12. Control of the sliding valve 35 provides a proper air/media mix for optimum granulating results. The auger feeder assembly 38 can be controlled to have a variable, selectable speed.

Types of media which have been successfully granulated with an embodiment of the invention include: dried grains, dried beans, moist media that finishes dry, petroleum coke, oil shale, mezotrace, ore and mineral bearing sands, ash, dried sewage sludge, wood, drywall, and glass.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved media granulation apparatus that is low in cost, relatively simple in design and operation, and which may advantageously be used to prevent ground material to become trapped between a drive shaft, which rotates a grinding element, and a grinding chamber. With the invention, a media granulation apparatus is provided which does not need a seal between a grinding element and a drive shaft. With the invention, a media granulation apparatus is provided which does not undergo vibrations caused by a rotating grinding element. With the invention, a media granulation apparatus is provided which carries heat away from the material being ground. With the invention, a media granulation apparatus is provided which collects the dust produced during the grinding process. With the invention, a media granulation apparatus is provided which includes means for collecting particles in the desired size range and includes means for recycling particles larger than desired. With the invention, a media granulation apparatus is provided which permits control of the time period in which the material undergoes the grinding operation. With the invention, a media granulation apparatus is provided which includes means for conveying material from one station to another without losing material. With the invention, a media granulation apparatus is provided which permits the grinding process to be carried out continuously. With the invention, a media granulation apparatus is provided which provides conveying means which are simple and do not include moving parts.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved media granulation apparatus, comprising:

a cyclone chamber assembly which includes an outer wall, a plurality of vortex controller assemblies connected to said outer wall, and an inner wall, said cyclone chamber assembly also including an inlet, a dust vent tube, and a granulated media outlet, a first conduit connected to said inlet of said cyclone chamber assembly, a blower assembly, connected to said first conduit, for creating a cyclone flow within said cyclone chamber assembly, and a media feed assembly connected to said first conduit for supplying media to be ground to said cyclone chamber assembly, wherein:

said outer wall includes a plurality of outer wall flat portions, said inner wall includes a plurality of inner wall flat portions, and wherein said inner wall flat portions are arranged to define a plurality of apexes therebetween, said inner wall flat portions confronting said outer wall flat portions such that a perpendicular plane passing through an outer wall portion intersects an apex common to two adjacent inner wall sections.

2. The apparatus described in claim 1 wherein said cyclone chamber assembly includes a funnel-shaped collector portion connected to said outer wall and positioned below said outer wall and said inner wall and above said granulated media outlet.

3. The apparatus described in claim 2 wherein a portion of said dust vent tube extends below said outer wall and said inner wall into said funnel-shaped collector portion.

4. The apparatus described in claim 1 wherein said media feed assembly includes:

a hopper, legs for supporting said hopper, a feed conduit connected to said hopper , an auger feeder assembly connected to said feed conduit for moving media from said hopper through said feed conduit to said first conduit which feeds into said cyclone chamber assembly.

5. The apparatus described in claim 1, further including:

an air classifier assembly connected to said cyclone chamber assembly at said granulated media outlet, said air classifier assembly capable of separating granulated media into media of a selected particle size range.

6. The apparatus described in claim 5 wherein said air classifier assembly is also capable of recycling media that is larger than the selected particle size range back to a media hopper.

7. The apparatus described in claim 1, further including:

a dust collection assembly connected to said dust vent tube of said cyclone chamber assembly.

8. The apparatus described in claim 7 wherein said dust collection assembly includes:

interconnection conduit connected to said dust vent tube of said cyclone chamber assembly, and a baghouse assembly connected to said interconnection conduit for collecting and bagging dust from said cyclone chamber assembly.

9. The apparatus described in claim 1 wherein:

said plurality of said outer wall flat portions is equal in number to said plurality of said inner wall flat portions.

10. A new and improved media granulation apparatus, comprising:

a cyclone chamber assembly which includes an outer wall, a plurality of vortex controller assemblies connected to said outer wall, and an inner wall, said cyclone chamber assembly also including an inlet, a dust vent tube, and a granulated media outlet, a first conduit connected to said inlet of said cyclone chamber assembly, a blower assembly, connected to said first conduit, for creating a cyclone flow within said cyclone chamber assembly, and a media feed assembly connected to said first conduit for supplying media to be ground to said cyclone chamber assembly, wherein said respective vortex controller assemblies include:

a vortex control element which is cylindrical in cross-section, a pivot for connecting one end of said vortex control element to said outer wall, and a slot-riding connector connected to said vortex control element for riding in an arced slot in said outer wall, said vortex control element to be selectively tilted around said pivot allowing said slot-riding connector to ride in said arced slot for controlling an angular orientation of said vortex control element within said cyclone chamber assembly, such that, by controlling the angular orientation of said vortex control element within said cyclone chamber assembly, granulation time of media in said cyclone chamber assembly is controlled.

* * * * *